United States Patent [19]

Nelham

[11] 4,145,449

[45] Mar. 20, 1979

[54] MULTI-COMPARTMENT FOOD PACKAGE

[75] Inventor: Roy W. Nelham, Cheltenham, Canada

[73] Assignee: R. Nelham & Associates Incorporated, Mississauga, Canada

[21] Appl. No.: 868,816

[22] Filed: Jan. 12, 1978

[30] Foreign Application Priority Data

Jun. 13, 1977 [GB] United Kingdom ..... 24659/77

[51] Int. Cl.[2] ..... B65D 25/08

[52] U.S. Cl. ..... 426/120; 206/219; 206/620; 206/631; 206/632; 229/56; 426/115; 426/130

[58] Field of Search ..... 426/119, 120, 123, 115, 426/128, 130; 206/219, 632, 631, 633, 620, 634; 229/56, 48 SB, 72

[56] References Cited

U.S. PATENT DOCUMENTS

| | | | |
|---|---|---|---|
| 2,401,110 | 5/1946 | Rohdin | 426/120 X |
| 2,527,919 | 10/1950 | Drangle | 426/120 |
| 2,741,559 | 4/1956 | Banowitz | 426/120 |
| 2,793,955 | 5/1957 | Selmer | 426/119 |
| 3,294,227 | 12/1966 | Schneider et al. | 206/219 |
| 3,441,418 | 4/1969 | Nishikiori | 426/94 X |
| 3,469,768 | 9/1969 | Repko | 229/56 |
| 3,511,436 | 5/1970 | Kessler | 426/113 |

FOREIGN PATENT DOCUMENTS

| | | | |
|---|---|---|---|
| 697723 | 9/1953 | United Kingdom | 426/120 |

*Primary Examiner*—Steven L. Weinstein
*Attorney, Agent, or Firm*—Sim & McBurney

[57] ABSTRACT

A multi-compartment package for the packaging of food products takes the form of a generally flat rectangular pouch-like package which is permanently closed at the side edges, has a temporary seal at the top edge and a bottom closure. A further temporary seal extends between the top and bottom of the package separating the interior of the package into two separate compartments. The package is opened by separation along the temporary seals to result in a one compartment package open at the top. The invention has particular applicability to the packaging of the components of an ice-cream sandwich.

7 Claims, 4 Drawing Figures

MULTI-COMPARTMENT FOOD PACKAGE

FIELD OF INVENTION

The present invention relates to a package.

BACKGROUND TO THE INVENTION

The packaging of food for storage, transportation and/or sale often requires hermetic sealing of the packaging structure to prevent spoilage of the food between the time of manufacture and the time of use. Packages of many shapes and types have been used including flexible, generally planar packages intended to package food items which lie generally flat. Such packages have been made of polymeric material which is heat sealed at its edges to achieve and maintain the hermetic sealing. Access to the contents of the package requires tearing of the package.

In some instances, it is convenient to package two or more materials which are associated in use in the same package. However, certain combinations of products are capable of adversely interacting when packed together. In this connection, it has been previously suggested to form two or more separate compartments within the same package containing such materials by using suitable permanent heat seals.

SUMMARY OF INVENTION

The present invention is directed to a novel generally planar package for dissimilar materials. The present invention is particularly directed to a package for holding the items forming an ice-cream sandwich and will be described with particular reference thereto. An ice-cream sandwich consists of a rectangular block of hard ice-cream positioned between two edible rectangular crisp frangible wafers of substantially the same dimension as the faces of the ice-cream block and which abut those faces.

The package of the present invention is formed of two overlying sheets of flexible heat-sealable generally air and moisture impervious material of substantially the same dimensions and preferably rectangular in shape which are provided with a permanent heat seal join along two parallel edges, a heat seal join along one of the remaining edges, a temporary heat seal join along the other remaining edge and a temporary heat seal join extending between said remaining edges at a location between said parallel edges and dividing the interior of the package into two separate compartments.

The term "permanent heat seal" as used herein refers to a single seal line or plurality of closely-spaced seal lines along which the joined materials are permanently fusingly joined and the joined materials cannot be separated one from another along the seal line.

The term "temperature separable heat seal" as used herein refers to a single seal line or a plurality of closely spaced seal lines along which the joined materials are fusingly joined in such a way that the joined materials may be separated from one another along the seal line without destruction to the integrity of the material.

When the package of the present invention is used to package the components of an ice-cream sandwich, the compartments are elongate, the ice-cream block is held in one compartment while the two wafers are held in the other. In this way, the ice-cream block and wafers are hermetically sealed from one another and moisture from the ice-cream block cannot adversely affect the crispness of the wafers, as would be the case if the components were packaged within the same enclosure.

The provision of the temporary seals effectively provides a hermetic sealing of the packaged material from the external atmosphere until such time as the package is desired to be opened. The package is opened by drawing apart the material of the package along the temporary seal lines, permitting ready access to the contents of the package without otherwise affecting the integrity of the package.

DESCRIPTION OF PREFERRED EMBODIMENT

Figure 1:
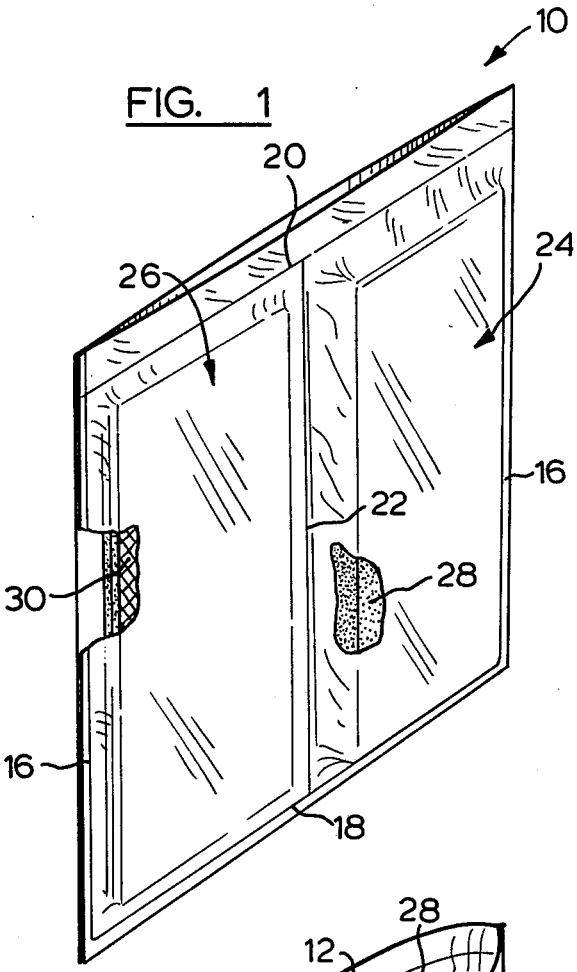
FIG. 1 is a perspective view, with parts cut away for clarity, of a package provided in accordance with one embodiment of the invention and housing the components of an ice-cream sandwich.

Referring to the drawings, which illustrate the presently preferred embodiment of the invention and the best mode known to the applicant, a package 10, in the form of a generally flat rectangular pouch-like product, is formed of overlying layers 12 and 14 of thin flexible heat-sealable substantially moisture- and air-impervious material, preferably plastic coated paper, which may be transparent, translucent or opaque, as desired.

Along each side edge of the package, the layers 12 and 14 are joined by a permanent heat seal 16 which constitutes a permanent closure of the package 10 along each side edge. The package 10 may be opened along these edges only by tearing one or more of the layers 12 and 14 in this region.

Along the bottom edge of the package 10, the layers 12 and 14 are joined by a further permanent seal 18, constituting a permanent closure of the package 10 along that edge. If desired, depending on the intended use of the structure, the seal 18 formed at the bottom edge of the package may be of the temporary type described below with respect to the top edge of the package 10.

A temporary seal 20 is provided along the top edge of the package 10 resulting in complete closure of the package 10. The temporary seal 20 is constructed in such a way that the layers 12 and 14 may be separated along the seal line without otherwise damaging the integrity of the package 10 and the individual sheets 12 and 14.

A further temporary seal line 22 extends between the bottom edge seal 18 and the top edge seal 20 at the location between the side edge seals 16, separating the interior of the package into two individual elongate compartments 24 and 26 which are hermetically sealed from each other in the closed package. In compartment 24 is located an ice-cream block 28 while in the compartment 26 is housed two crisp frangible edible wafers 30 in face-abutting relationship. The layers 12 and 14 usually tightly engage the material packaged in the respective compartments 24 and 26 to decrease spoilage due to air entrapped in the compartments 24 and 26.

The embodiment of the invention wherein the bottom seal 18 is also a temporary seal, as mentioned above, may be particularly beneficial in that the package 10 is openable at either end for customer convenience and may be simpler to manufacture on automatic equipment.

Figure 2:
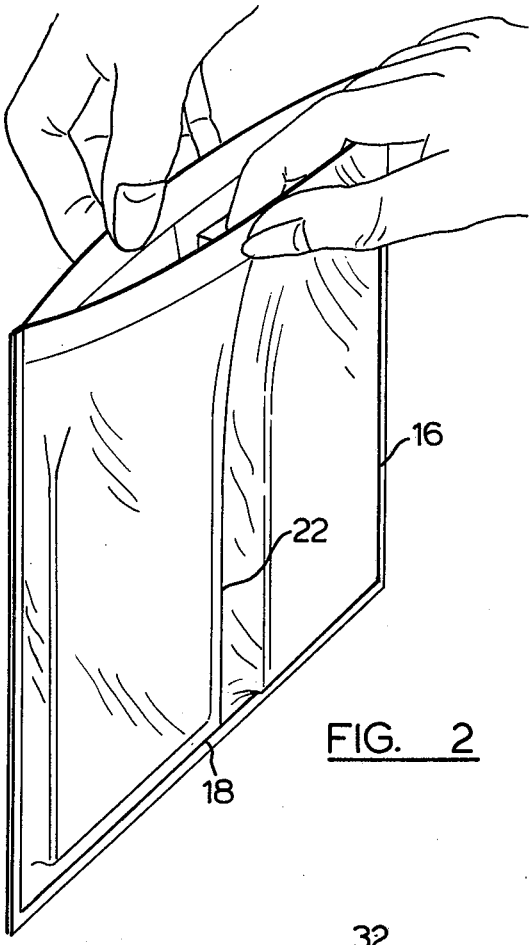
FIG. 2 is a perspective view of the package of FIG. 1 during the act of opening of the package.
Figure 3:
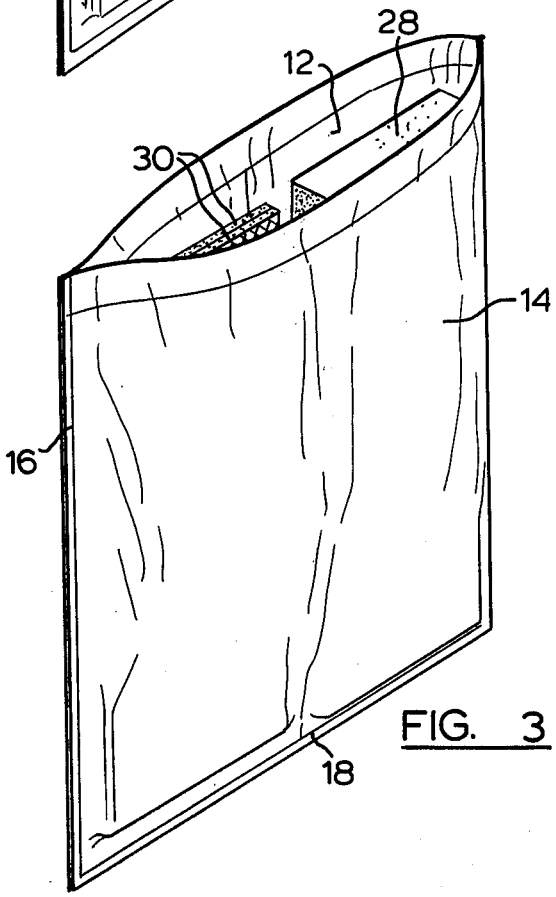
FIG. 3 is a perspective view of the package of FIG. 1 in the fully opened structure.

The package 10 may be opened, as illustrated in FIGS. 2 and 3 by drawing apart the layers 12 and 14 in the region of the top seal 20 which separates the layers 12 and along that seal and also along the compartment-dividing seal 22 to result in an opened single compartment package 10 (FIG. 3) sealed on three sides.

Figure 4:
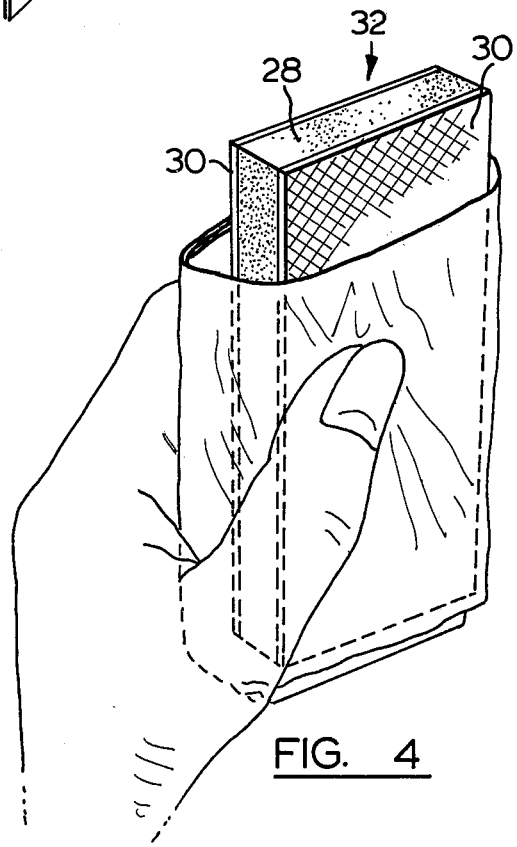
FIG. 4 is a perspective view of the opened package in use as a holder for an ice-cream sandwich.

Once the package 10 is opened in this way, ready access may be had to the contents of the package 10. An ice-cream sandwich 32 may be assembled from the ice-cream block 28 and the wafers 30, and the opened package may be used as a holder for the sandwich 32, as shown in FIG. 4. The use of the opened package in this way catches drips and prevents hand contact with the sandwich.

It will be seen that, although when the package 10 is sealed closed, the ice-cream block 28 and the wafers 30 are tightly held within the individual compartments, once the package 10 is opened and seals 20 and 22 are broken, the single compartment package which results permits ready removal of both the ice-cream block 28 and the wafers 30.

In place of superimposed layers 12 and 14 of heat sealable material heat sealed on four sides, the package 10 may be formed by folding a single sheet of heat sealable material on itself and heat sealing the remaining edges.

Since the ice-cream block 28 and the wafers 30 are hermetically sealed from the influence of the external atmosphere, a hygienic package wherein degradation as a result of outside influences is avoided is provided. Further, the wafers 30 are maintained in a crisp condition within the package 10 since they are separated from the influence of moisture from the ice-cream block 28.

The package 10 may be transported and stored in a convenient refrigeration unit until sold to maintain the ice-cream block 28 in its frozen condition. The package 10 may be stored in the flat condition shown in FIG. 1, or, perhaps more conveniently when multiple numbers of packages are to be stored in a confined space, in a folded condition in which the package 10 is folded about seal line 22 so that compartment 24 sits in abutment with compartment 26. Storage in this manner also may assist in preventing accidental damage to the wafers 18 as a result of the added rigidity achieved by juxtaposition to the relatively rigid block 16.

The external surfaces of the sheets 12 and 14 may be provided with brand identification material, opening instructions and other information, as desired.

The package of the invention has been described with reference to the preferred embodiment as comprising two compartments within the package. The invention is not limited thereto, and may be used in connection with any desired number of compartments within the package.

Further, while the invention has been described in connection with the packaging of food products, the invention also may be used for packaging any desired materials in separate compartments.

SUMMARY

The present invention, therefore, relates to a package having a unique structure and wide utility. Modifications are possible within the scope of the invention.

What I claim is:

1. A generally planar pouch-like package formed of overlying layers of heat-sealable flexible substantially air- and moisture-impervious material and having a generally rectangular shape with side edges and top and bottom edges, said package comprising permanent heat seals at each side edge thereof along which said overlying layers are not separable, a first temporary, separable heat seal closing the top edge of the package, a heat seal closing the bottom edge of the package, and at least one additional temporary, separable heat seal extending continuously from said top edge to said bottom edge intermediate said side walls and separating the interior of the package into separate compartments containing packaged items, said temporary, separable seals being so constructed that separation of the overlying layers may be effected therealong without otherwise damaging the integrity of the remainder of the package and the layers to permit opening of the package at said top edge to gain simultaneous access to the items packaged in said separate compartments and to permit formation of a single interior compartment by separation of the overlying layers along said at least one additional temporary, separable seal.

2. The package of claim 1 wherein each of said compartments contains the components of a food product and at least one of said components is adversely affected by at least one other component upon long storage, whereby location of said components in separate compartments of the package hermetically sealed from one another inhibits said adverse affect.

3. The package of claim 1 wherein said overlying layers are directly joined in separable manner in each said temporary seal.

4. The package of claim 1 wherein one additional temporary, separable heat seal only is provided and extends between the top and bottom edge heat seals parallel to said side edge seals.

5. The package of claim 4 wherein one compartment contains a rectangular block of ice-cream and the other compartment contains two frangible edible wafers in face abutting relation, said compartments being dimensioned to minimize the air space in each compartment and to position the ice-cream block and wafers with their longitudinal axes substantially parallel to said side edges, whereby, upon opening of the package by separation of the layers along said temporary, separable seals, a single compartment open-topped package results from which said ice-cream block and wafers may be readily removed.

6. The package of claim 5 wherein said bottom edge has a permanent heat seal.

7. The package of claim 5 wherein said bottom edge has a temporary, separable heat seal, whereby said package may be opened at either end.

* * * * *